US006664872B2

(12) United States Patent
Channabasappa et al.

(10) Patent No.: US 6,664,872 B2
(45) Date of Patent: Dec. 16, 2003

(54) IRIS-LESS COMBLINE FILTER WITH CAPACITIVE COUPLING ELEMENTS

(75) Inventors: Eswarappa Channabasappa, Nasha, NH (US); Chris McNamara, Millville, MA (US)

(73) Assignee: Tyco Electronics Corporation, Middletown, PA (US)

( * ) Notice: Subject to any disclaimer, the term of this patent is extended or adjusted under 35 U.S.C. 154(b) by 30 days.

(21) Appl. No.: 10/037,876

(22) Filed: Nov. 9, 2001

(65) Prior Publication Data

US 2003/0011447 A1 Jan. 16, 2003

Related U.S. Application Data

(60) Provisional application No. 60/305,050, filed on Jul. 13, 2001.

(51) Int. Cl.[7] ..... H01P 1/205
(52) U.S. Cl. ..... 333/202; 333/203
(58) Field of Search ..... 333/202, 206, 333/203, 207, 212, 134

(56) References Cited

U.S. PATENT DOCUMENTS

| | | | | | |
|---|---|---|---|---|---|
| 4,937,533 | A | * | 6/1990 | Livingston | 333/126 |
| 6,255,919 | B1 | * | 7/2001 | Smith | 333/202 |

FOREIGN PATENT DOCUMENTS

| | | | | |
|---|---|---|---|---|
| EP | 2039419 | * | 8/1980 | 333/203 |
| JP | 5372549 | * | 6/1978 | 333/203 |
| JP | 5819002 | * | 2/1983 | 333/206 |
| JP | 58131802 | * | 8/1983 | 333/203 |
| WO | WO9211664 | * | 7/1992 | 333/203 |

* cited by examiner

*Primary Examiner*—Robert Pascal
*Assistant Examiner*—Stephen E. Jones

(57) ABSTRACT

An iris-less combline filter and a method of providing the iris-less combline filter are disclosed. The filter includes a conductive housing, first and second resonators disposed in the housing, and at least one capacitive coupling element disposed between the first and second resonators, wherein there is no decoupling iris between the first and second resonators.

27 Claims, 6 Drawing Sheets

IRIS-LESS COMBLINE FILTER WITH CAPACITIVE COUPLING ELEMENTS

RELATED APPLICATION

The present application claims the priority benefit based on U.S. Provisional Application No. 60/305,050 filed on Jul. 13, 2001, entitled "Iris-Less Combline Filter Having Capacitive Coupling Elements", assigned to the assignee of the present application, which is herein fully incorporated by reference.

FIELD OF THE INVENTION

The present invention relates to electronic filters and, more particularly, to an iris-less combline filter with improved performance characteristics and low manufacturing costs.

BACKGROUND OF THE INVENTION

Conventional combline filters typically are used in front-end transmit/receive filters and diplexers of communication systems such as Personal Communication System (PCS), and Global System for Mobile communications (GSM). The combline filters are configured to pass only certain frequency bands of electromagnetic waves as needed by the communication systems. The combline filters can include uniform resonators rods or stepped resonator rods having steps.

FIG. 1 is a perspective view of a conventional combline filter 10 (with a cover removed therefrom) having uniform resonator rods. As shown, the combline filter 10 includes a plurality of uniform resonator rods 6 disposed within a metal housing 2, input and output terminals 12 and 14 disposed on the outer surface of the metal housing 2, and loops 16*a* and 16*b* for inductively coupling electromagnetic signals to and from the input and output terminals 12 and 14. The metal housing 2 is provided with a plurality of cavities 4 separated by dividing walls 4*a*. Certain dividing walls 4*a* have a well-known structure called a decoupling "iris" 8 having an opening 8*a*. The dividing wall 4*a* having the iris 8 is used to control the amount of coupling between two adjacent resonator rods 6, which controls the bandwidth of the filter. The resonator rods 6 resonate at particular frequencies to filter or selectively pass certain frequencies of signals inductively applied thereto. Particularly, input signals from the input terminal 12 of the combline filter 10 are inductively transmitted to the first resonator rod 6 through the loop 16*a* and are filtered through the resonance of the resonator rods 6. The filtered signals are then outputted at the output terminal 14 of the combline filter 10 through the loop 16*b*.

A combline filter having stepped resonator rods is also known in the art. In such a filter, resonator rods having steps are used in lieu of the uniform resonator rods. The structure of this filter would be identical to that of the filter 10 shown in FIG. 1, except that the uniform resonator rods 6 are replaced with stepped resonator rods and different dimensions may be used. This type of filter also has the decoupling irises and multiple dividing walls to control the coupling coefficients between the stepped resonator rods.

In all these conventional combline filters, the passing frequency range of the filter is selectively varied by changing the lengths or dimensions of the resonator rods whether they be uniform rods or stepped rods. The operational bandwidth of the filter is selectively varied by changing the electromagnetic (EM) coupling coefficients between the resonator rods. The EM coupling coefficient represents the strength of EM coupling between two adjacent resonator rods and equals the difference between the magnetic coupling coefficient and the electric coupling coefficient between the two resonator rods. The magnetic coupling coefficient represents the magnetic coupling strength between the two resonator rods, whereas the electric coupling coefficient represents the electric coupling strength between the two resonator rods. Usually, the magnetic coupling coefficient is larger than the electric coupling coefficient.

To vary the EM coupling (i.e., EM coupling coefficient) between two resonator rods, the size of the iris opening disposed between the two resonator rods is varied. The larger the iris between the two resonator rods, the higher the EM coupling between the two resonator rods. This results in a wide bandwidth operation of the filter. In contrast, if the iris 8 has a smaller opening, a lower EM coupling between the resonator rods is effected, resulting in a narrow bandwidth operation of the filter.

Although effective, conventional combline filters with decoupling irises have a number of problems or drawbacks. For instance, the cavities, dividing walls and decoupling irises in the metal housing must be formed very precisely. Thus, the conventional combline filters require sophisticated milling, which increases costs and decreases throughput. Further, the plurality of dividing walls erected between the resonator rods of the filter significantly increases the signal loss known as "insertion loss". Moreover, if different bandwidth characteristics are desired for the combline filter, the metal housing of the filter must be re-machined to change the size of the iris openings. In this respect, the milling of the metal housing only allows the iris openings to be enlarged (e.g., by removing a portion of the dividing wall), but does not allow a reduction in the size of the iris openings. Thus, if a decrease in the coupling coefficient between the resonator rods is desired, the metal housing cannot be re-machined and the entire filter housing must be replaced to provide the desired coupling coefficient. Conventional combline filters are therefore restricted in applicability and adaptability.

Accordingly, there is a need for an improved combline filter which overcomes the above-described problems and other problems that are associated with conventional combline filters.

SUMMARY OF THE INVENTION

The present invention presents an innovative approach for controlling the EM coupling between resonators (resonator rods) which overcomes problems that are associated with conventional combline filters. Particularly, the present invention eliminates the use of decoupling irises and instead utilizes a capacitive coupling element to enhance electric coupling between resonators to control the overall EM coupling between the resonators. In one embodiment, the capacitive coupling element is a conductive rod supported by a non-conductive support member and disposed between two adjacent resonators. The capacitive coupling element is placed between the resonators, without contacting the resonators, where the electrical field is dominant, which improves the electric coupling between the resonators. In another embodiment, the capacitive coupling element is a conductive rod attached to one of two adjacent resonators, and is placed between the two resonators where the electrical field is dominant, which improves the electric coupling between the resonators. An increase in the electric coupling decreases the overall EM coupling between the resonators.

Then, by selectively varying the dimensions of the capacitive coupling element which varies the amount of electric coupling present between the two resonators, the present invention controls the overall EM coupling between the two resonators without the use of decoupling irises. The use of capacitive coupling elements according to the present invention provides many advantages over conventional combline filters having decoupling irises. For example, a capacitive coupling element is more configurable than a decoupling iris. To modify the size of the iris openings to vary the EM coupling between the resonators, the entire metal housing needs to be re-machined. In contrast, in the present invention, only the capacitive coupling element needs to be reconfigured. Reconfiguration of the capacitive coupling element may involve trimming the ends of the capacitive coupling element, which can be easily accomplished, or replacing the capacitive coupling element with a new capacitive coupling element having different dimensions and/or configurations, which also can be easily accomplished. For instance, If less EM coupling is desired between two resonators, the existing capacitive coupling rod can be replaced with a longer capacitive coupling rod or a thicker capacitive coupling rod, or the height of the coupling rod can be increased. Thus, by merely varying the length, thickness, diameter, and/or height of the capacitive coupling elements and without requiring re-machining or replacement of the metal housing as in the conventional combline filters, the present invention permits easy modifications to EM coupling between the resonators.

Furthermore, the present invention eliminates the use of de-coupling irises and thereby reduces the number of dividing walls needed in the filter. This feature reduces the milling cost associated with manufacturing the filter, thereby greatly decreasing the manufacturing cost and time for the filter. This feature also reduces the insertion loss for the filter, which is typically caused by dividing walls, and thereby improves the performance characteristics of the filter. Moreover, the use of the capacitive coupling elements in conjunction with the resonators allows for signal attenuation zeros close to the passband of the filter, thereby providing high selectivity for the filter.

In one embodiment, the present invention is directed to a filter comprising a conductive housing, first and second resonators disposed in the housing, and at least one capacitive coupling element disposed between the first and second resonators, wherein there is no decoupling iris between the first and second resonators.

In another embodiment, the present invention is directed to a method of providing a filter, the method comprising the steps of providing a conductive housing, disposing first and second resonators in the housing, and disposing at least one capacitive coupling element between the first and second resonators, no decoupling iris existing between the first and second resonators.

In yet another embodiment, the present invention is directed to a method of providing a filter, comprising the steps of providing a conductive housing; disposing an integrated unit in the housing, the integrated unit including a resonator section and a capacitive coupling element section extending directly from the resonator section; and disposing a resonator in the housing a predetermined distance from the integrated unit, wherein there is no decoupling iris between the integrated unit and the resonator, and the capacitive coupling element section of the integrated unit controls coupling between the resonator and the resonator section of the integrated unit.

BRIEF DESCRIPTION OF THE DRAWINGS

In the drawings, the same reference numerals are used to indicate the same elements.

DETAILED DESCRIPTION OF THE PREFERRED EMBODIMENTS

Figure 1:
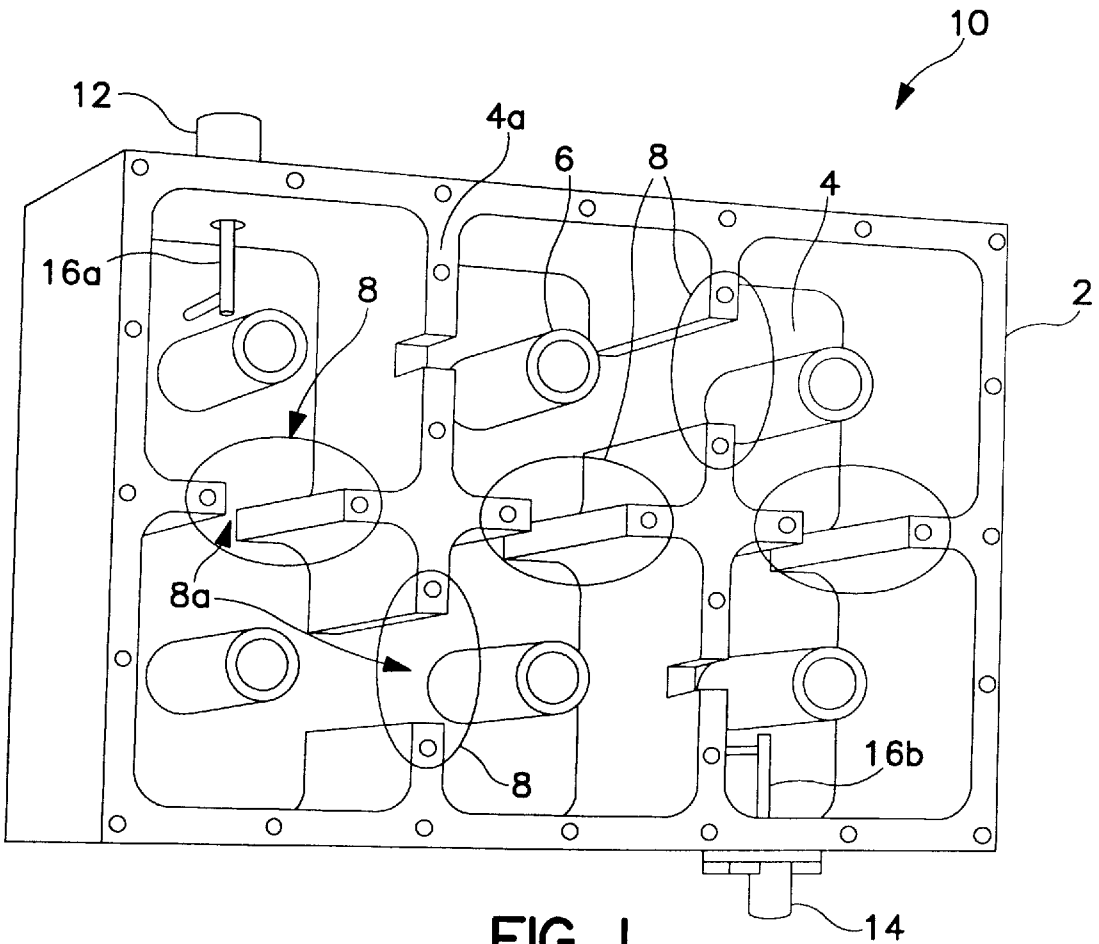
FIG. 1 CONVENTIONAL ART
FIG. 1 is a perspective view of a conventional combline filter with a cover removed therefrom.
Figure 2:
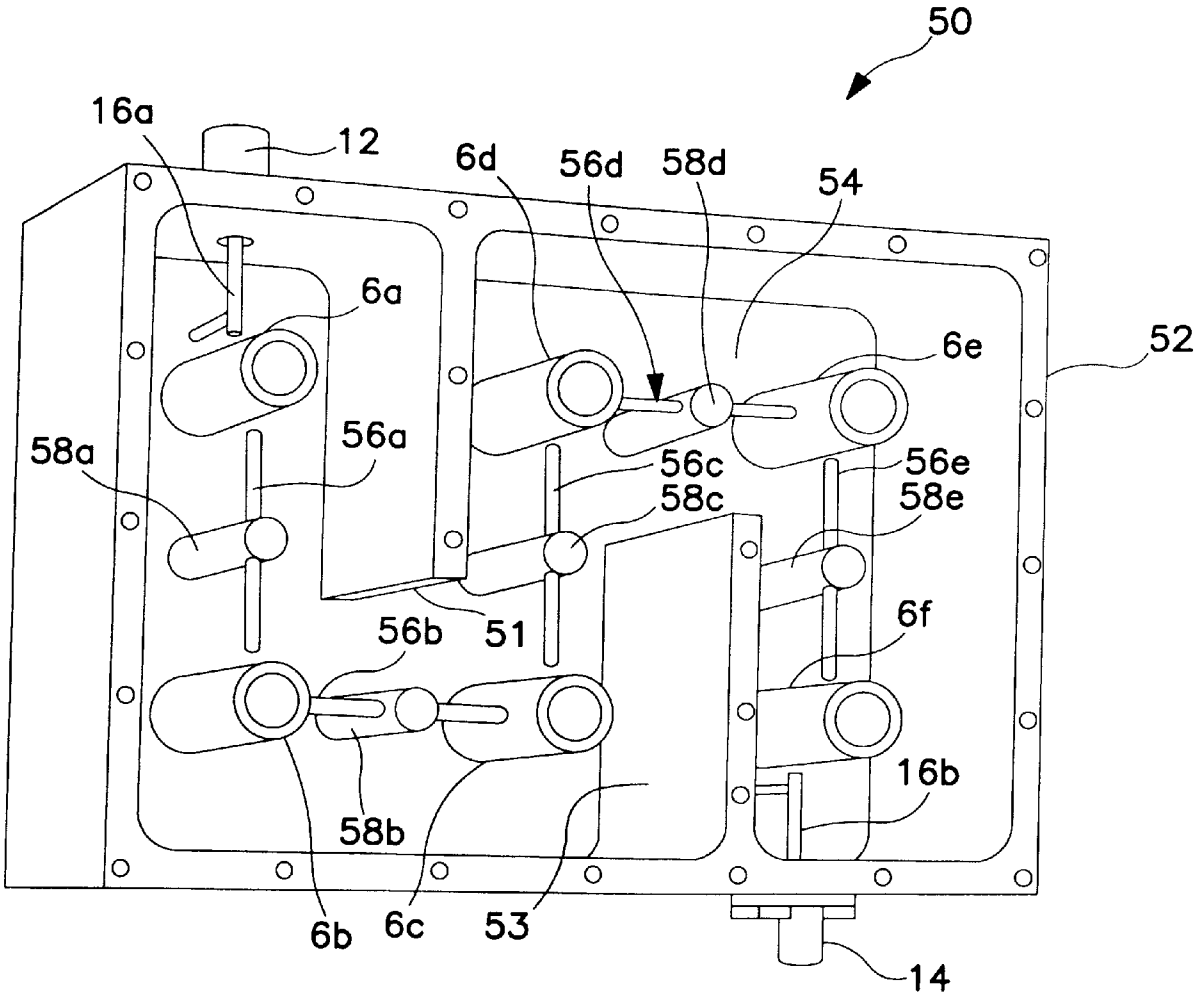
FIG. 2 is a perspective view of a combline filter with a cover removed therefrom according to one embodiment of the present invention.

FIG. 2 is a perspective view of a combline filter 50 with a cover removed therefrom according to one embodiment of the present invention. As shown in FIG. 2, the combline filter 50 includes a metal housing 52 having a meandering cavity 54 and two dividing walls 51 and 53, a plurality of resonators 6*a*–6*f* disposed within the cavity 54 of the metal housing 52, and a plurality of capacitive coupling elements 56*a*–56*e* each disposed between two of the resonators 6*a*–6*f*. The combline filter 50 further includes input and output terminals 12 and 14 disposed on the outer surface of the metal housing 52, and loops 16*a* and 16*b* for inductively coupling electromagnetic signals to and from the input and output terminals 12 and 14.

The resonators 6*a*–6*f* are uniform rods and can be mounted on the bottom inner surface of the metal housing 52 using known techniques. For example, threads can be provided on the ends of the resonators 6*a*–6*f* and the resonators 6*a*–6*f* can be screwed into the bottom inner surface of the metal housing 52 configured to receive the resonators 6*a*–6*f*. The metal housing 52 and the resonators 6*a*–6*f* are made with conductive materials. For instance, the housing 52 can be made with aluminum plated with silver.

The capacitive coupling elements 56*a*–56*e* are conductive rods for selectively limiting the EM coupling between two adjacent resonators. Each of the first through fifth coupling elements 56*a*–56*e* is perpendicularly disposed with respect to the projection direction of the two resonators and does not contact the corresponding two resonators. Each of the first through fifth coupling elements 56*a*–56*e* extends through the space between two of the resonators 6*a*–6*f* without directly contacting the resonators 6*a*–6*f*, so that it is aligned with the middle portions of the corresponding two resonators where the electric field is dominant or the strongest, i.e., along a line intersecting the longitudinal axes of the two adjacent resonators. The position of the capacitive coupling elements 56*a*–56*e* increases the electric coupling between the two resonators. Since the overall EM coupling coefficient between the two resonators is the difference between the magnetic coupling coefficient and the electric coupling coefficient, the increase in the electric coupling coefficient decreases the overall EM coupling coefficient between the two resonators. Thus, by selectively varying the dimensions of the capacitive coupling elements 56*a*–56*e*, which improve the electric coupling between the resonators, the overall EM coupling between the resonators can be selectively varied.

The capacitive coupling elements 56*a*–56*e* are positioned between the resonators by using support members 58*a*–58*e* which are made with a non-conductive material providing low signal loss such as polytetrafluoroethylene and, more specifically, the form of polytetrafluoroethylene sold under the trade name Teflon®manufactured by E.I. du Pont de Nemours and Company. Each of the capacitive coupling elements 56*a*–56*e* is supported by the corresponding support member 58 provided between two of the resonators. For instance, the first capacitive coupling element 56*a* is supported between the first and second resonators 6*a* and 6*b* by the first support member 58*a*, the second capacitive coupling element 56*b* is supported between the second and third resonators 6*b* and 6*c* by the second support member 58*b*, and so on.

One skilled in the art would readily understand that, according to well-established electromagnetic theories and filter characteristics, dividing walls may be needed between certain resonator rods. For example, in the six-section (six resonator rods) filter of FIG. 2, the dividing wall 51 is needed between the first and fourth resonators 6*a* and 6*d* in order to prevent EM coupling therebetween, which might otherwise occur because they are physically adjacent each other. Specifically, the intended operation of filter 50 is for the signal input at terminal 12 to be coupled from resonator 6*a* to resonator 6*b* and then from resonator 6*b* to resonator 6*c* and then from resonator 6*c* to resonator 6*d* and so on. Accordingly, EM coupling directly between resonator 6*a* and 6*d* should be prevented (by means of wall 51).

When electromagnetic signals are applied to the input terminal 12, these input signals are inductively coupled to the first resonator 6*a* by the loop 16*a*. Then the resonators 6*a*–6*f* resonate to pass certain frequencies of the input signals. The capacitive coupling elements 56*a*–56*e* selectively couple the signals between the resonator 6*a* to control the bandwidth at which the filtering process occurs. Then the filtered signals are outputted from the sixth resonator 6*f* and inductively coupled to the output terminal 14 by the loop 16*b*. As a result, the filtered signals are outputted at the output terminal 14 of the filter.

Figure 3C:
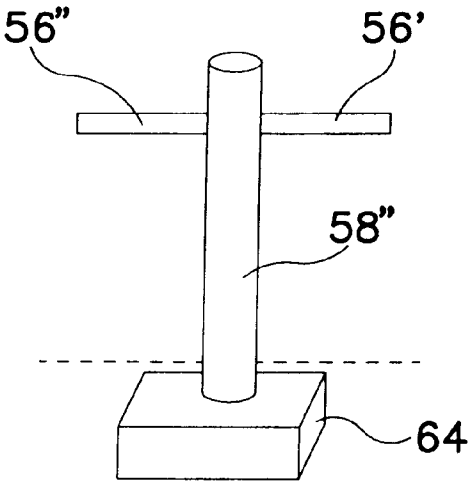
FIG. 3C is a support member coupled to a pair of capacitive coupling elements usable in the combline filter of FIG. 2 according to still another embodiment of the present invention.
Figure 3B:
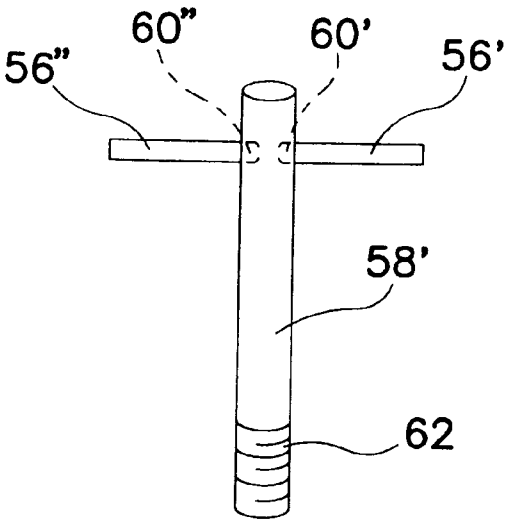
FIG. 3B is a diagram of a support member coupled to a pair of capacitive coupling elements usable in the combline filter of FIG. 2 according to another embodiment of the present invention.
Figure 3A:
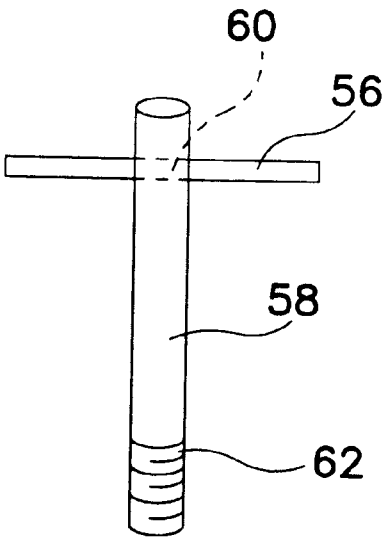
FIG. 3A is a diagram of a support member coupled to a capacitive coupling element usable in the combline filter of FIG. 2 according to one embodiment of the present invention.

FIGS. 3A–3C show three different examples 58, 58', 58" of a support member 58*a*, 58*b*, 58*c*, 58*d*, or 58*e* for supporting at least one capacitive coupling element for use in the filter 50 according to different embodiments of the present invention. These examples are provided only to demonstrate that a variety of different schemes can be used to provide support members for the capacitive coupling elements of the present invention. Obviously, other examples are possible and contemplated as part of the present invention.

As shown in FIG. 3A, in accordance with one embodiment, the support member 58 is a non-conductive rod having a threaded portion 62 at one end portion thereof and a transverse through hole 60 near the other end portion thereof. A capacitive coupling element 56 (56*a*, 56*b*, 56*c*, 56*d* or 56*e*) having a rod configuration is inserted through the hole 60 so that equal portions of the coupling element 56 project from the support member 58. If desired, known fastening techniques such as glue, tape, mating threads, screws, etc., can be used to secure the position of the coupling element 56 within the hole 60 of the support member 58. The threaded portion 62 of the support member 58 is screwed into a threaded hole located at the bottom inner surface of the metal housing 52. The height of the coupling element 56 with respect to the corresponding two resonators (i.e., the distance between the coupling element 56 and the bottom inner surface of the housing 52) can be changed easily by varying the degree in which the support member 58 is screwed into the metal housing 52. The height of the coupling element 56 affects the coupling coefficient between the corresponding two resonators.

In another embodiment, the hole 60 can be made large so that the coupling elements 56 of different diameters or thicknesses can be interchangeably positioned within the hole 60. In such cases, additional fastening techniques may be used to securely position the coupling element 56 in the hole 60.

The structures discussed in connection with FIG. 3A allow easy modification of coupling coefficients between the resonators because it allows the size, shape and/or configuration of the capacitive coupling element 56 to be changed easily, which controls the EM coupling coefficients between the resonators. For instance, to increase the EM coupling between the resonators, the length of the coupling element 56 can be easily reduced by either trimming the end portion (s) of the coupling element 56 or replacing the coupling element 56 with a new capacitive coupling element having a shorter length or cross-section. On the other hand, to decrease the EM coupling between the resonators, the length of the coupling element 56 can be increased easily by replacing the coupling element 56 with a new capacitive coupling element having a greater length and/or cross-section.

In accordance with another embodiment as shown in FIG. 3B, a pair of capacitive coupling elements 56' and 56" are used in lieu of one capacitive coupling element 56. The support member 58' includes two blind holes 60' and 60" disposed on the opposite sides of the support member 58' for receiving the pair of capacitive coupling elements 56' and 56". Alternately, a single through hole as in the FIG. 3A embodiment still may be used. The support member 58' also includes the threaded portion 62 for selectively varying the height of the coupling elements 56' and 56" as discussed above. If desired, the coupling elements 56' and 56" can be further secured in the holes 60' and 60" of the support member 58' by using any existing fastening techniques. For instance, the holes 60' and 60" and one end of each of the coupling elements 56' and 56" can be threaded so that the coupling elements 56' and 56" can be screwed into the holes 60' and 60" respectively. Glue, tape, screws or any other fastener can also be used to secure the coupling elements 56' and 56" in the holes 60' and 60" of the support member 58'. With the configurations discussed in connection with FIG. 3B, the EM coupling coefficient between the resonators can be varied easily because the size, shape and/or configuration of the coupling elements 56' and 56" can be varied easily, e.g., by trimming or replacing the coupling elements 56' and 56".

In another embodiment, as an alternative to having the holes 60' and 60" in the support member 58', the capacitive coupling elements 56' and 56" can be attached to the outer surface of the support member 58' using known fasteners such as glue, tape, screws, etc.

In accordance with still another embodiment as shown in FIG. 3C, the support member 58" is disposed on a base member 64. The base member 64 will be disposed underneath the bottom surface of the metal housing 52 so that only the support member 58" projects from the bottom surface of the metal housing 52. The support member 58" can be mounted on the base member 64 in any known manner. The pair of coupling elements 56' and 56" are attached to the outer surface of the support member 58" by a fastener such as glue, tape, screws, etc. However, one or two capacitive coupling elements can be coupled to the support member 58" in any matter, such as by using the holes 60, 60', 60" as discussed above.

In other embodiments, if desired, the capacitive coupling elements may be securely positioned between the resonators by a support structure that is coupled to any other part of the metal housing and/or the cover. For instance, if needed, the support members may be supported by the cover, rather than by the bottom surface of the metal housing, so that the support members hang from the cover.

In addition to the above described examples, the present invention contemplates as part of the invention a variety of different schemes that can be used to provide capacitive coupling element(s) between two resonators without contacting the resonators. Any scheme for extending the capacitive coupling element(s) between corresponding two resonators can be used as long as the capacitive coupling element(s) can be positioned in the space gap between the corresponding two resonators where the electric field is dominant or strongest. For instance, the support member and at least one capacitive coupling element of the present invention can be integrally formed as one unit. In this case, the EM coupling coefficient control may be achieved by replacing the integrated unit with a different integrated unit providing the desired coupling coefficient. In another example, instead of having the capacitive coupling element 56 within the hole 60 of the support member 58 as in FIG. 3A, the coupling element 56 may be attached to a side or top surface of the support member 58. In still another example, multiple support members can be used to support the capacitive coupling element(s) between corresponding two resonators.

Although the support members (e.g., members 58, 58', 58") have been described above as having rod configurations, they can have any different configurations, sizes, cross-sections and/or shapes. For example, the support member can be a square rod, an oval rod, a cone shaped member, etc.

Figure 4:
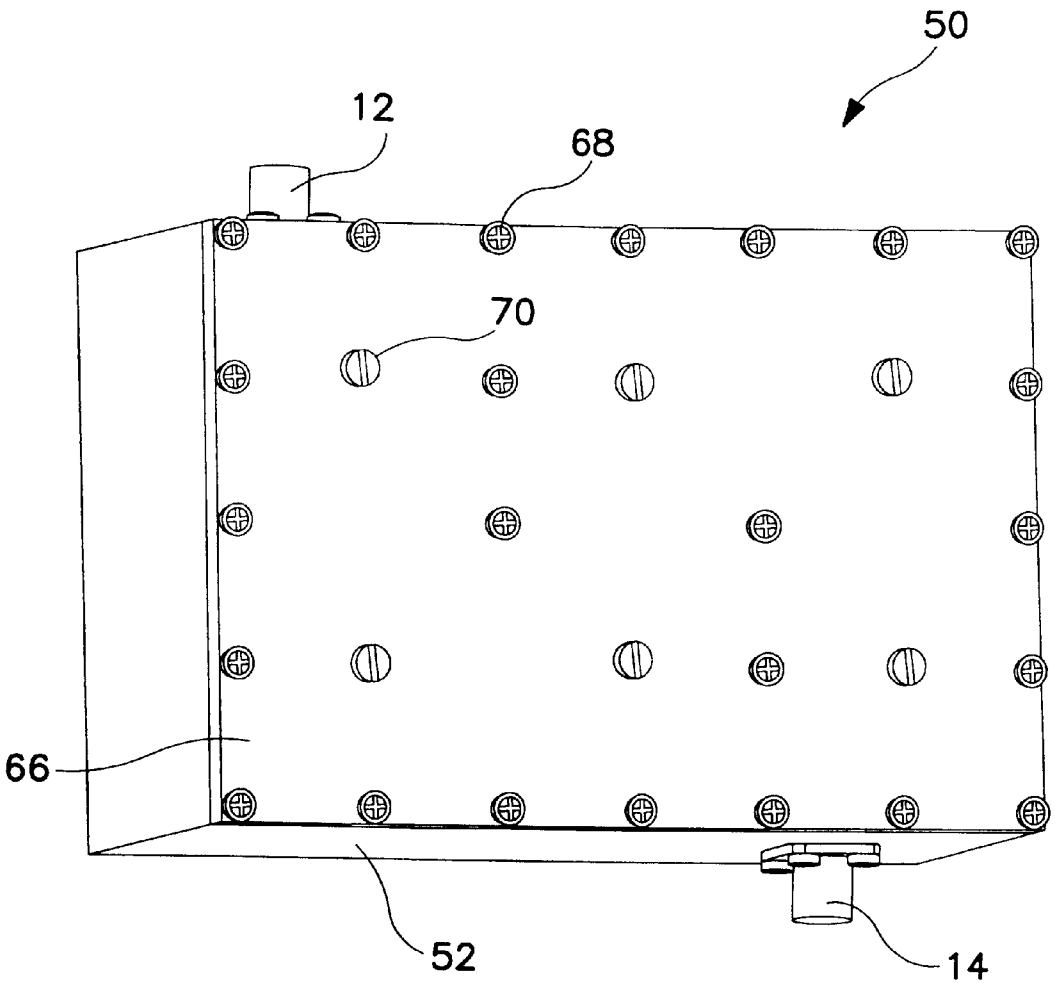
FIG. 4 is a perspective view of the combline filter of FIG. 2 that is assembled with a cover according to one embodiment of the present invention.

FIG. 4 is a perspective view of the combline filter 50 assembled with a cover 66 according to one embodiment of the invention. The cover 66 is made with a conductive material such as aluminum and is fastened to the housing 52 by using a known fastener such as screws 68. The combline filter 50 may include, if needed, a plurality of tuning screws 70 for fine tuning the filter characteristics of the filter 50 according to known techniques. Typically, these tuning screws 70 are positioned above the resonators 6*a*–6*f*.

Figure 5A:
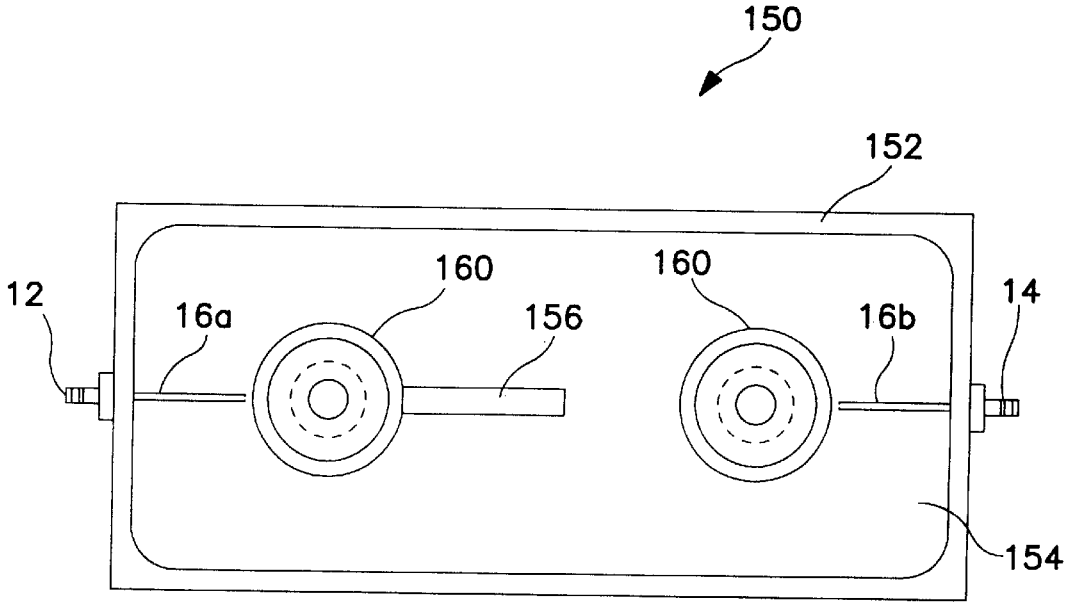
FIG. 5A is a top plan view of a combline filter with a cover removed therefrom according to another embodiment of the present invention.
Figure 5B:
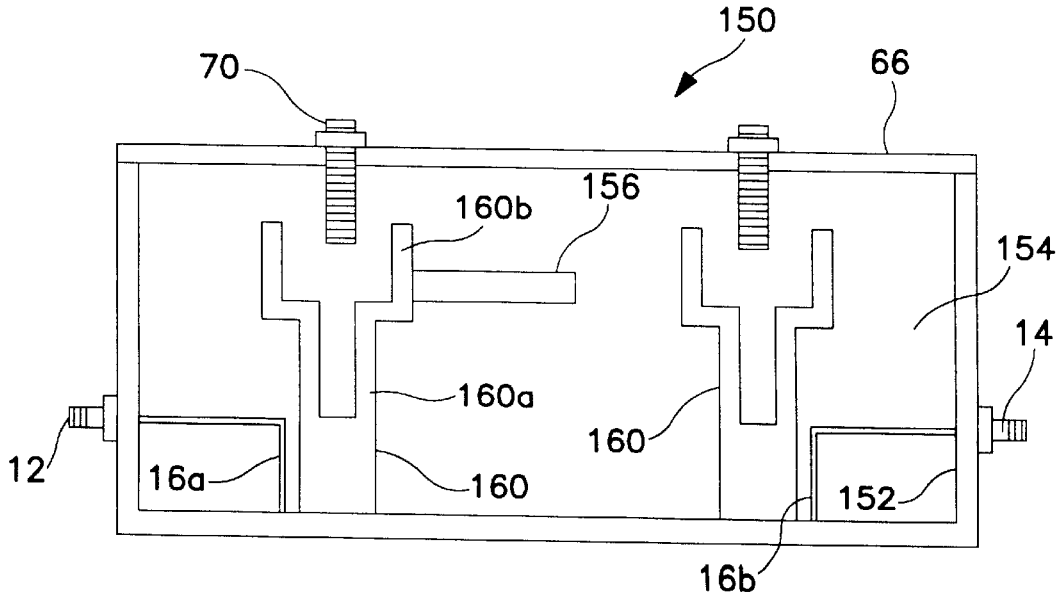
FIG. 5B is a longitudinal sectional view of the combline filter of FIG. 5A.

FIG. 5A is a top plan view of a combline filter with a cover removed therefrom according to another embodiment of the present invention and FIG. 5B is a longitudinal sectional view of the combline filter of FIG. 5A. As shown in FIGS. 5A and 5B, the combline filter 150 includes a metal housing 152 having a cavity 154, a pair of resonators 160 disposed within the cavity 154 of the metal housing 152, and a capacitive coupling element 156 attached to each one of two adjacent resonators 160. Each of the resonators 160 is a stepped resonator rod having stepped cross-section(s) and can be mounted on the bottom inner surface of the metal housing 152 using known techniques such as screws or threaded stepped resonator rods. The metal housing 152 and the resonators 160 are made with conductive materials. For instance, the housing 152 may be formed of aluminum plated with silver.

The combline filter 150 further includes input and output terminals 12 and 14 disposed on the outer surface of the metal housing 152, loops 16*a* and 16*b* for inductively coupling electromagnetic signals to and from the input and output terminals 12 and 14, and tuning screws 70 (optionally provided) for fine tuning the filter characteristics of the filter 150 according to known techniques. Typically, the tuning screws 70 are positioned above the resonators 160.

The capacitive coupling element 156 is a conductive rod for selectively controlling the EM coupling between the two resonators 160. The capacitive coupling element 156 is perpendicularly disposed with respect to the projection direction of the two resonators 160 and directly contacts one of the two resonators 160. The capacitive coupling element 156 extends preferably through the space between the two resonators 160 so that it is aligned with the middle portions or any portions of the two resonators 160 where the electric field is the strongest or dominant. This allows the capacitive coupling element 156 to increase the electric coupling between the two resonators 160. Since the overall EM coupling coefficient between the two resonators is the difference between the magnetic coupling coefficient and the electric coupling coefficient, the increase in the electric coupling coefficient decreases the overall EM coupling coefficient between the two resonators. Thus, by selectively varying the dimensions of the capacitive coupling element 156, the overall EM coupling between the two resonators 160 can be selectively varied.

Figure 6:
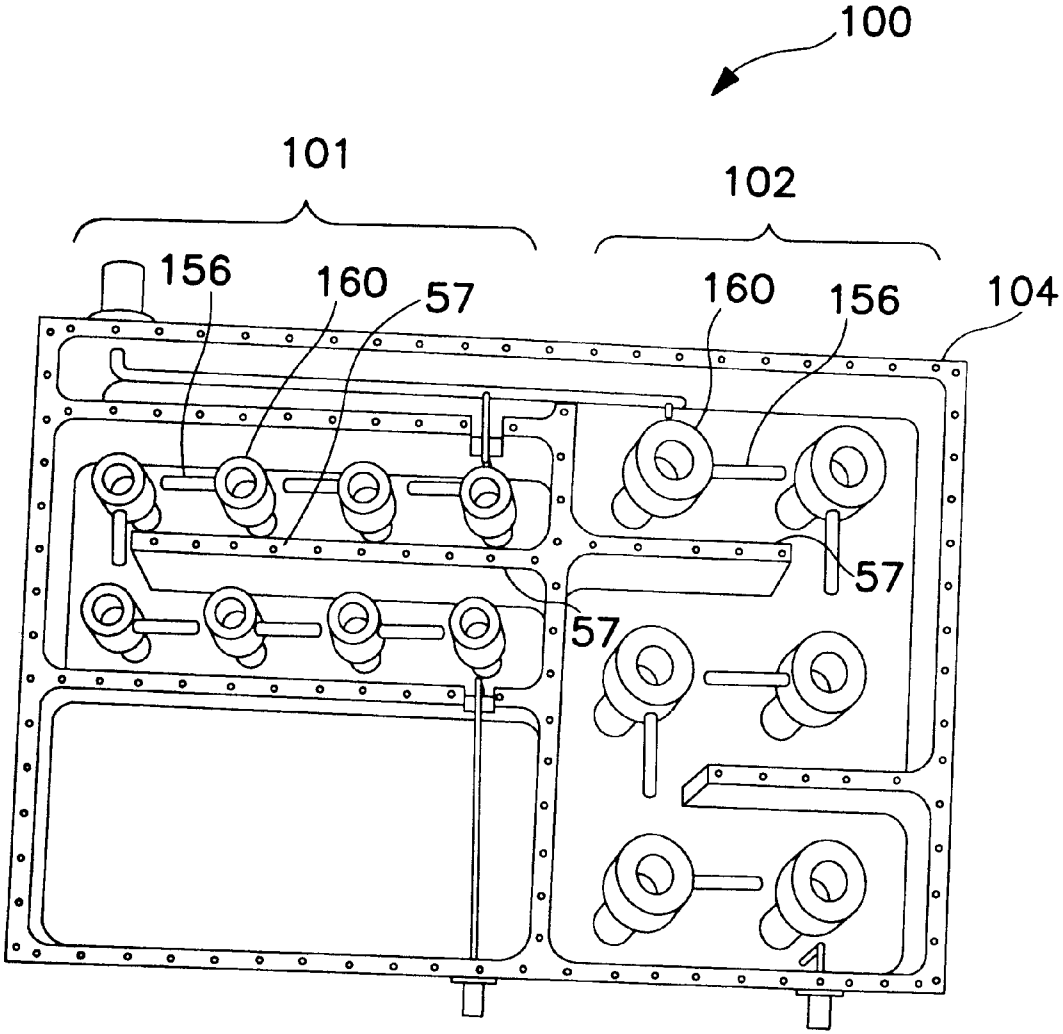
FIG. 6 is a perspective top plan view of a combline filter according to still another embodiment of the present invention.

FIG. 6 is a perspective top plan view of a combline filter having stepped resonators according to another embodiment of the present invention. As shown in FIG. 6, a combline filter 100 according to this embodiment includes a metal housing 104 with multiple cavities and that is separated into a receive filter section 101 and a transmit filter section 102. The receive filter section 101 includes eight resonators 160 and seven capacitive coupling elements 156 arranged in a particular manner. Each capacitive coupling element 156 is attached to first through seventh resonators 160 so that a capacitive coupling element exists between two adjacent resonators. The receive filter section 101 further includes a dividing wall 57 for separating the resonators 160 according to known techniques. The transmit filter section 102 includes six resonators 160 and five capacitive coupling elements 156 arranged in a particular manner. Each capacitive coupling element 156 in the transmit filter section 102 is attached to first through fifth resonators 160 so that a capacitive coupling element exists between every pair of adjacent resonators. The transmit filter section 102 further includes dividing walls 57 that are well known in the art.

When electromagnetic signals are applied to the input terminal of the filter 150 or 100, these input signals are inductively coupled to the first resonator and the resonators 160 resonate to pass certain frequencies of the input signals. The capacitive coupling elements control the bandwidth in which the filter operates by controlling the EM couplings between the resonators 160. Filtered signals are then inductively coupled from the last resonator to the output terminal of the filter by the corresponding coupling loop so that the filtered signals are output at the output terminal of the filter.

One skilled in the art would readily understand that, according to well-established electromagnetic theories and filter characteristics, certain dividing walls such as the dividing walls 57 may be needed between resonators for successful operation of the filter.

Figure 7:
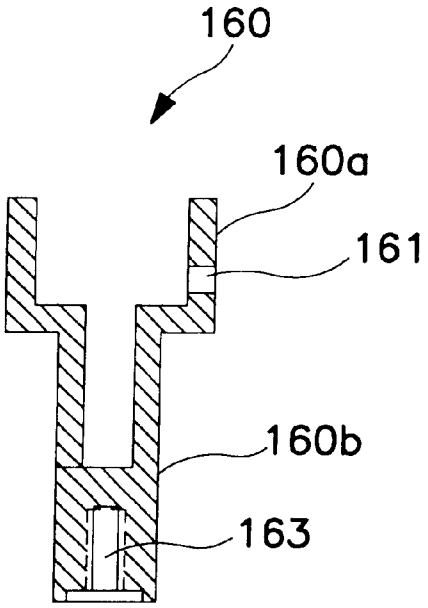
FIG. 7 is a cross-sectional view of an example of a stepped resonator rod usable in the combline filter shown in FIGS. 2, 5A and 6 according to one embodiment of the present invention.

FIG. 7 shows one example of a stepped resonator 160 that may be used in the present invention according to one embodiment of the present invention. In accordance with one embodiment, the resonator 160 is a non-conductive stepped rod having an upper portion 160*a* and a lower portion 160*b* extending from the upper portion 160*a*. The diameter or cross-section of the upper portion 160*a* is greater than the diameter or cross-section of the lower portion 160*b*. The resonator 160 further includes a transverse through hole 161 disposed in one wall of the upper portion 160*a*. The capacitive coupling element 156 which may have a rod configuration or other shape is inserted into the hole 161 so that the capacitive coupling element 156 projects horizontally from the side of the upper portion 160*a* of the resonator 160. If desired, known fastening techniques such as glue, tape, screws, etc., can be used to secure the position of the capacitive coupling element 156 within the hole 161 of the resonator 160.

In another embodiment, the hole 161 does not completely pass through the wall of the upper portion 160*a*. In still another embodiment, the hole 161 and one end of the capacitive coupling element 156 are matingly threaded so that the capacitive coupling element 156 can be rotatably inserted into the hole 161. This feature can enhance the interchangeability of capacitive coupling elements in and out of the hole 161 without requiring re-machining or other costly processes. For instance, all the capacitive coupling elements of varying thickness and/or length can have the same-sized end that is threaded. To change the EM coupling coefficient between the resonators, all that is required is to remove the existing capacitive coupling element from the hole 161 (e.g., by unscrewing it from the hole 161) and insert a new capacitive coupling element of appropriate thickness and/or length into the hole 161 (e.g., by screwing it into the hole 161).

In another embodiment, the hole 161 can be made large so that the capacitive coupling elements of different diameters or thicknesses can be interchangeably positioned within the hole 161. In such cases, known fasteners may be used to secure the position of the capacitive coupling element in the hole 161. In still another embodiment, as an alternative to having the hole 161 in the upper portion 160*a* of the resonator 160, the capacitive coupling element 156 can be attached directly onto the outer surface of the upper portion 160*a* so that the capacitive coupling element 156 points to the adjacent capacitive coupling element. This can be accomplished using known fasteners such as screws, etc.

The resonator 160 can be fastened to the inner bottom surface of the metal housing (e.g., housing 152) using any known techniques. For example, a screw 163 or other fasteners can be used. In another example, threads can be provided at the end of the lower portion 160*b* of the resonator 160 and a corresponding threaded hole can be provided at the bottom inner surface of the metal housing. Then the threaded portion of the resonator 160 is rotatably inserted into the threaded hole located at the bottom inner surface of the metal housing. By having the threaded portion at the resonator 160, the height of the capacitive coupling element 156 (i.e., distance between the capacitive coupling element and the bottom inner surface of the metal housing) can be changed easily by varying the degree to which the resonator 160 is screwed into the metal housing. The height of the capacitive coupling element 156 affects the EM coupling coefficient between the corresponding two resonators.

In addition to the above described examples, the present invention contemplates as part of the invention a variety of different schemes that can be used to provide the capacitive coupling element between two resonators. Any scheme for attaching or directly connecting a capacitive coupling element to one of the corresponding two resonators and extending it between the two resonators can be used. For instance, the resonator and the capacitive coupling element of the present invention can be integrally formed as one unit so that the integrated unit is composed of a resonator section and a capacitive coupling element section directly extending from the resonator section. In this case, the EM coupling coefficient control may be achieved by replacing the integrated unit with a different integrated unit providing the desired coupling coefficient.

According to the present invention, although a certain number of resonators are illustrated in the drawings, the filter of the present invention can have any number of resonators depending on the application. The number of capacitive coupling elements and support members (if needed) present in the filter will then vary appropriately depending on the number of resonators in the filter. Moreover, the shape, size and/or configuration of the filter housing (e.g., housing 52 or 152) can vary depending on the application. For example, the filter housing can be in the shape of a square box or a rectangular box depending on the number of resonators needed in the filter housing. Further, although the resonators of the present invention are shown in the drawings as round resonator rods, they can have other shapes, sizes and/or configurations such as square-faced resonator rods, etc. Moreover, other types of resonators can be used in the filters of the present invention. For example, in the filter 50 shown in FIG. 2, the resonators 6*a*–6*f* can be replaced with stepped resonators such as the resonator 160 shown in FIGS. 5A and 7. In another example, the stepped resonators 160 in the filters 100 and 150 shown in FIGS. 5A and 6 can be replaced with the resonators 6*a*–6*f* shown in FIG. 2. In these cases, appropriate dimensions for the components of the filter can be selected according to the present invention to achieve the desired or optimal performance characteristics.

It should be noted that the combline filters of the present invention are without any decoupling iris for controlling EM coupling between resonators. Instead, the present invention utilizes a capacitive coupling element disposed between resonators to control the EM coupling coefficient between the two adjacent resonators. By varying the size, length, thickness, and/or "height" (distance from the bottom surface of the filter housing) of the capacitive coupling elements, the EM coupling coefficients between the resonators can be easily varied. The use of the capacitive coupling elements also replaces some of the dividing walls, thereby reducing a number of dividing walls needed in the filter. As a consequence, the size of the overall housing for the filter can be reduced significantly, thereby producing a more compact combline filter.

The present invention is applicable to any system requiring filters such as communication systems, e.g., Personal Communication System (PCS), Digital Communication System (DCS), Global System for Mobile communications (GSM), and 3G. The size, shape and/or configurations of the capacitive coupling elements, support members and/or resonators can be selected appropriately to achieve the desired filter characteristics in an optimal manner. Further, the concept of utilizing capacitive coupling elements to control EM coupling coefficients between resonators without the use of decoupling irises and/or decoupling walls according to the present invention is equally applicable to other types of filters such as interdigital filters, dielectric filters which employ combline or interdigital geometries, etc.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A filter comprising:

a conductive housing;

first and second resonators disposed in the housing;

a non-conductive support member for supporting at least one capacitive coupling a element between the first and second resonators, the coupling element disposed without contacting said first and second resonators; and the at least one capacitive coupling element disposed between the first and second resonators, the support member includes a threaded portion disposed at one end portion thereof and the housing includes a mating threaded portion for accepting the threaded portion of the support member, wherein the position of the capacitive coupling element can be varied with respect to a surface of the housing by varying an amount by which the support member is threaded into the housing;

wherein there is no decoupling iris between the first and second resonators.

2. The filter of claim 1, wherein the filter is at least one of the following: a combline filter or an interdigital filter.

3. The filter of claim 1, further comprising:

a cover coupled to the housing for encapsulating the first and second resonators;

at least one tuning screw disposed above at least one of the first and second resonators;

an input terminal and an output terminal disposed on an outer surface of the housing; and a pair of loops for inductively coupling the input and output terminals to at least one of the first and second resonators.

4. The filter of claim 1, wherein the support member includes a through hole disposed at another end portion thereof for supporting the capacitive coupling element therein.

5. The filter of claim 1, wherein each of the first and second resonators is a stepped rod with a stepped cross-section.

6. The filter of claim 1, wherein the at least one capacitive coupling element has a rod configuration and extends between the first and second resonators where an electric field is dominant.

7. The filter of claim 1, wherein the at least one capacitive coupling element is attached to an outer surface of the support member.

8. A filter comprising:

a conductive housing;

first and second resonators disposed in the housing, wherein there is no decoupling iris between the first and second resonators;

a non-conductive support member for supporting at least one capacitive coupling element between the first and second resonators, the coupling element disposed without contacting said first and second resonators; and the at least one capacitive coupling element disposed between the first and second resonators, wherein the at least one capacitive coupling element includes a pair of capacitive coupling elements, and the support member includes a pair of holes disposed at one end portion thereof for supporting respectively the pair of capacitive coupling elements therein.

9. The filter of claim 8, wherein the capacitive coupling elements are attached to an outer surface of the support member.

10. The filter of claim 8, wherein the capacitive coupling elements have a rod configuration and extend between the first and second resonators where an electric field is dominant.

11. The filter of claim 8, wherein each of the first and second resonators is a stepped rod with a stepped cross-section.

12. The filter of claim 8, further comprising:

a cover coupled to the housing for encapsulating the first and second resonators;

at least one tuning screw disposed above at least one of the first and second resonators;

an input terminal and an output terminal disposed on an outer surface of the housing; and a pair of loops for inductively coupling the input and output terminals to at least one of the first and second resonators.

13. The filter of claim 8, wherein the filter is at least one of the following: a combline filter or an interdigital filter.

14. A method of providing a filter, the method comprising the steps of:

providing a conductive housing;

disposing first and second resonators in the housing; and disposing at least one capacitive coupling element between the first and second resonators without contacting said first and second resonators and with no decoupling iris existing between the first and second resonators; and supporting the capacitive coupling element between the first and second resonators using a non-conductive support member;

wherein the at least one capacitive coupling element includes a pair of capacitive coupling elements, and the support member includes a pair of holes disposed at one end portion thereof for positioning respectively the pair of capacitive coupling elements therein.

15. The method of claim 14, wherein the support member includes at least one through hole disposed at one end portion thereof for positioning the capacitive coupling elements therethrough.

16. The method of claim 14, wherein the capacitive coupling elements are attached to an outer surface of the support member.

17. The method of claim 14, wherein the capacitive coupling elements have a rod configuration and extend between the first and second resonators where an electric field is dominant.

18. The method of claim 14, wherein each of the first and second resonators is a stepped rod with a stepped cross-section.

19. The method of claim 14, further comprising:

providing a cover coupled to the housing for encapsulating the first and second resonators;

disposing at least one tuning screw above at least one of the first and second resonators;

disposing an input terminal and an output terminal on an outer surface of the housing; and providing a pair of loops adjacent the input and output terminals for inductively coupling the input and output terminals to at least one of the first and second resonators.

20. The method of claim 14, wherein the filter is at least one of the following: a combline filter or an interdigital filter.

21. A method of providing a filter, the method comprising the steps of:

providing a conductive housing;

disposing first and second resonators in the housing; and disposing at least one capacitive coupling element between the first and second resonators, no decoupling iris existing between the first and second resonators, the coupling element disposed without contacting said first and second resonators; and supporting the capacitive coupling element between the first and second resonators using a non-conductive support member, wherein the support member further includes a threaded portion disposed at one end portion thereof and the housing includes a mating threaded portion for accepting the threaded portion of the support member, wherein the position of the capacitive coupling element can be varied with respect to a surface of the housing by varying an amount by which the support member is threaded into the housing.

22. The method of claim 21, wherein the support member includes a through hole disposed at one end portion thereof for positioning the capacitive coupling element therethrough.

23. The method of claim 21, wherein the at least one capacitive coupling element has a rod configuration and extends between the first and second resonators where an electric field is dominant.

24. The method of claim 21, wherein each of the first and second resonators is a stepped rod with a stepped cross-section.

25. The method of claim 21, further comprising providing a cover coupled to the housing for encapsulating the first and second resonators; disposing at least one tuning screw above at least one of the first and second resonators; disposing an input terminal and an output terminal on an outer surface of the housing; and providing a pair of loops adjacent the input and output terminals for inductively coupling the input and output terminals to at least one of the first and second resonators.

26. The method of claim 21, wherein the filter is at least one of the following: a combline filter or an interdigital filter.

27. The method of claim 21, wherein the at least one capacitive coupling element is attached to an outer surface of the support member.

* * * * *